US005972262A

United States Patent [19]

Huber

[11] Patent Number: 5,972,262

[45] Date of Patent: Oct. 26, 1999

[54] METHOD OF AND DEVICE FOR PRODUCING SHAPED PARTS

[75] Inventor: Helmut Huber, Gronau, Germany

[73] Assignee: Werzalit AG + CO, Oberstenfeld, Germany

[21] Appl. No.: 09/139,911

[22] Filed: Aug. 26, 1998

[30] Foreign Application Priority Data

Oct. 10, 1997 [EP] European Pat. Off. ..... 97117550

[51] Int. Cl.[6] ..... B27N 5/00

[52] U.S. Cl. ..... 264/83; 264/120; 425/381

[58] Field of Search ..... 264/109, 83, 101, 264/102, 120; 425/381

[56] References Cited

U.S. PATENT DOCUMENTS

| | | | |
|---|---|---|---|
| 4,358,418 | 11/1982 | Heggenstaller | 264/120 |
| 4,923,656 | 5/1990 | Held | 264/83 |
| 4,935,182 | 6/1990 | Ehner et al. | 264/112 |
| 5,078,938 | 1/1992 | Munk et al. | 264/109 |
| 5,413,746 | 5/1995 | Birjukov | 264/118 |
| 5,433,905 | 7/1995 | Tisch | 264/109 |

FOREIGN PATENT DOCUMENTS 0 443 053 A1 8/1991 European Pat. Off. .

*Primary Examiner*—Mary Lynn Theisen
*Attorney, Agent, or Firm*—Michael J. Striker

[57] ABSTRACT

In a method of and a device for producing shaped parts, a pressing piston is longitudinally displaceable in a tube provided with a pressing mold so that in a first pressing stroke it slightly compresses a mixture of cuttings and/or fiber material with a binder, and in a second stroke it finally compresses the mixture.

11 Claims, 3 Drawing Sheets

METHOD OF AND DEVICE FOR PRODUCING SHAPED PARTS

BACKGROUND OF THE INVENTION

The present invention relates to a method of producing shaped parts from a not flowable mixture of cutting and/or fiber materials and heat-hardenable binders.

More particularly, it relates to a method of the above mentioned type in which the mixture is finally pressed in a press with a pressing mold closed from all sides and therefore hardened, and a part of a heat quantity required for hardening is supplied by hot gas or vapor introduced during pressing into the mixture. The gas or vapor is introduced into the mixture located in the pressing mold in a direction which is substantially perpendicular to the pressing direction. The present invention also relates to a device for producing such shaped parts.

A method of the above mentioned general type is known and disclosed for example in the European patent document EP-A-0443 053. It has been recommended and practice for producing the shaped parts which are formed as individual pieces or as multi use elements. It is believed that the existing methods and devices can be further improved.

SUMMARY OF THE INVENTION

Accordingly, it is an object of present invention to provide a method of and a device for producing of shaped parts, in which the shaped parts can be produced endlessly and their volume is completely hardened.

In keeping with these objects and with others which will become apparent hereinafter, one feature of present invention resides, briefly stated, in a method of producing shaped parts, in accordance with which the mixture located in the pressing mold is pressed by at least two pressing strokes so that during the first pressing stroke the pressing mold is closed while the mixture is slightly compressed, and during the second pressing stroke the mixture is finally compressed.

When the method is performed in accordance with the present invention, a strand-shaped part can be produced from the mixture endlessly, and the heat quantity required during the pressing process is supplied in a sufficient manner and uniformly distributed in the volume. The end product is strand-shaped part which has a uniform hardness. The strand-shaped part can be also subdivided into required sizes after the hardening.

In accordance with another feature of the present invention, the hot gas or vapor after the first pressing stroke is introduced into the mixture, and the mixture after the second pressing stroke is additionally heated by a heating device.

Still another feature of the present invention is a device for producing of shaped parts, which has a tube in which a pressing piston is longitudinally displaceable, a radially arranged filling opening on the pressing mold, a plurality of supply passages arranged on the filling opening in the stroke region of the pressing piston and open at least into a collecting conduit connected with a reservoir for hot gas or vapor, and the pressing piston is controlled so that it performs after the actuation first a smaller pressing stroke and thereafter a greater pressing stroke.

In accordance with still another feature of present invention, the pressing device is arranged horizontally, or inclinedly, or vertically.

In accordance with a further feature of the present invention, the pressing piston is hollow and provided with a tubular extension extending into the pressing chamber, the rear end of the tubular extension is connected with a supply for hot gas or vapor, and in the front region of the tubular extension, outlet openings are provided in the compression region of the mixture.

Still another feature of the inventive device is that the surface of the pressing piston which faces the compression region is provided with a structuring.

Finally, the filling device has a filling shaft arranged parallel to the pressing mold and having a lower end which opens toward a stroke region, and a filling slider which is horizontally displaceable toward the stroke region.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
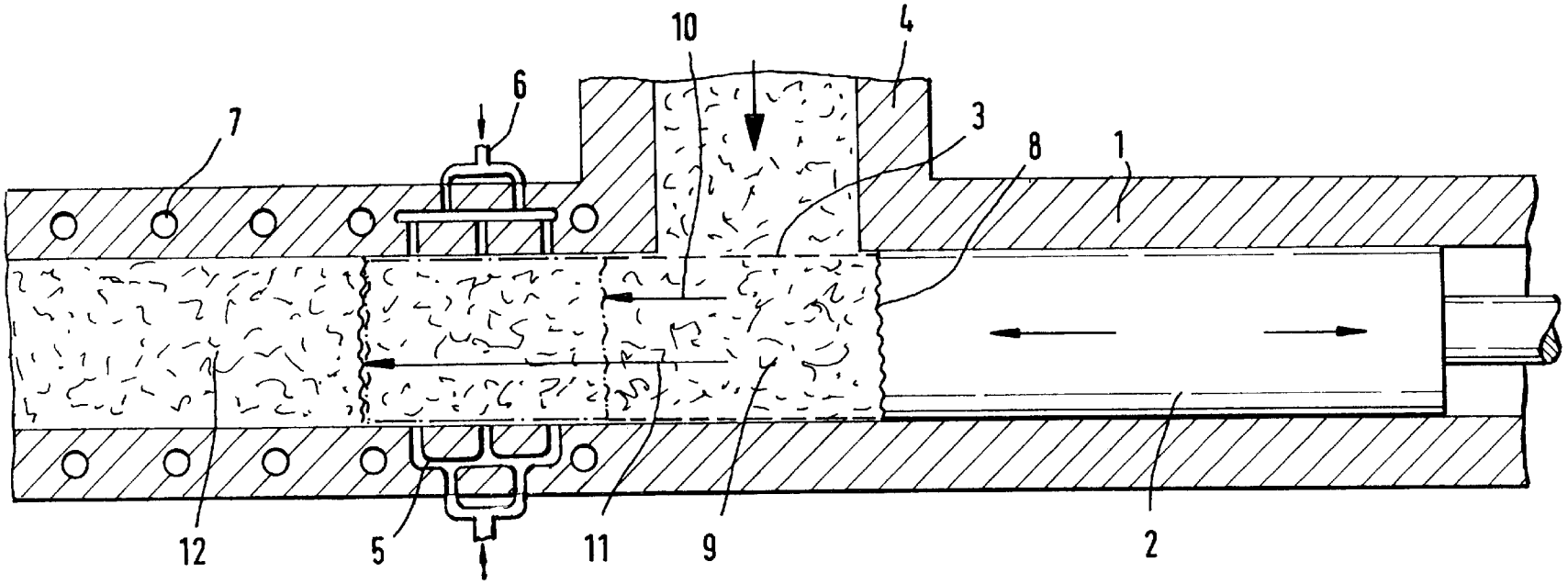
FIG. 1 is a view showing an arrangement in accordance with the present invention for performing an inventive method of producing shaped parts, wherein a pressing mold is arranged horizontally.

As can be seen from FIG. 1, a pressing device in accordance with the present invention has a tube 1 of a great length. In other words, the length of the tube amounts to a multiplicity of the pressing strokes. A pressing piston 2 is arranged longitudinally displaceably in the tube 1. A filling opening 3 is provided at a side of the tube 1. It is located at the end of a filling shaft 4, through which a mixture to be pressed is supplied into a pressing mold into the interior of the tube 1.

Behind the filling opening as considered in the pressing direction, supply passages 5 are formed in the wall of the tube. They serve for supplying a hot gas or vapor and are connected through a collecting conduit 6 with a not shown reservoir. Moreover, a heating structure 7 is provided in the wall of the tube. The heating structure 7 can be formed for example as an electrical heating unit or a heating unit operated by a hot fluid. The outer surface of the pressing piston is structured. For example, the outer surface of the pressing piston is provided with a knurling 8.

The pressing device shown in FIG. 1 operates in the following manner:

In the position of the pressing piston shown in FIG. 1 the mixture to be pressed is supplied through the filling shaft 4 and the filling openings 3 into the pressing mold 9. When the pressing mold 9 is filled, the pressing piston 2 is urged to perform the first pressing stroke, and for the this purpose the pressing piston is displaced to the end of the arrow 10. Thereby, the right end of the pressing mold is closed. The insignificantly compressed mixture is supplied by the heating structure with hot gas or vapor through the supply passages 5 and with such a heat quantity which is needed for hardening of the binder contained in the mixture.

After this, the pressing piston 2 is urged to perform the second pressing stroke as illustrated by the arrow 11. The mixture is finally pressed to its final density and hardened. During the second pressing stroke, the pressing piston 2 is displaced further toward the shaped part 12 in the pressing direction. The knurling 8 in the pressing piston 2 serves so as to produce a corresponding knurling on the end surfaces of the pressed shaped part, so that it can be easily connected to a strand.

The inner contour of the tube 1 is formed in correspondence with the shaped part to be produced. The tube 1 can have for example a circular cross-section. The cross-section can be also square or multi-cornered. It is also possible to reduce the cross-section in the pressing region, so that during the second pressing stroke an additional pressure from the periphery is provided.

Figure 2:
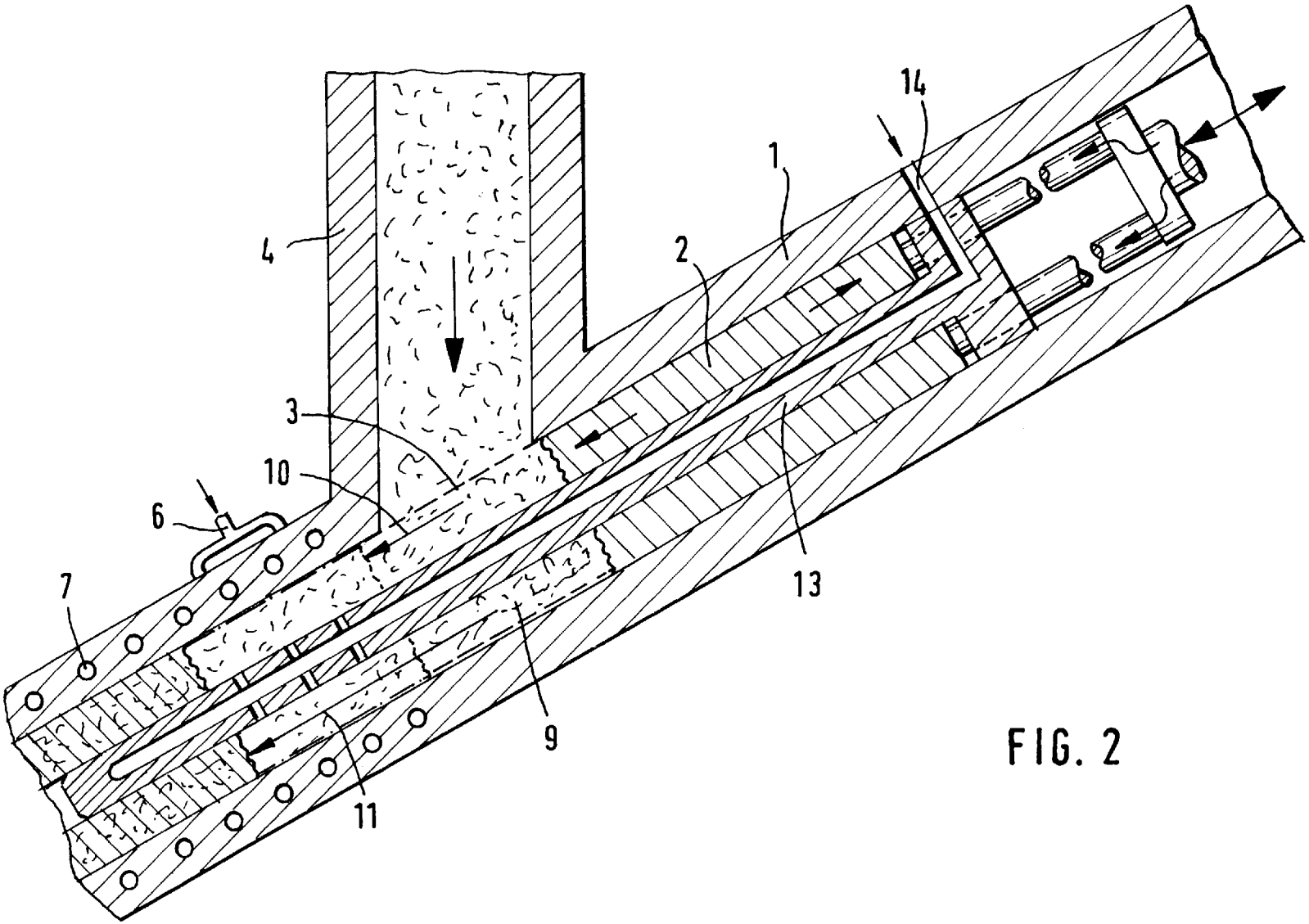
FIG. 2 is a view showing the arrangement in accordance with the present invention, in which the pressing mold is arranged inclinedly.

In the pressing device in accordance with the embodiment shown in FIG. 2, the part which corresponds to the parts of the pressing arrangement of FIG. 1 are identified with the same reference numerals. The difference between the pressing arrangements, is that the tube 1 is arranged so that it is inclined relative to a horizontal plane. In this manner, the filling of the mixture into the pressing mold 9 is facilitated. Moreover, the pressing piston is hollow, and a tubular extension 13 is arranged in it. Therefore after the first pressing stroke, hot gas or vapor can be supplied from inside into the slightly compressed mixture.

Figure 3:
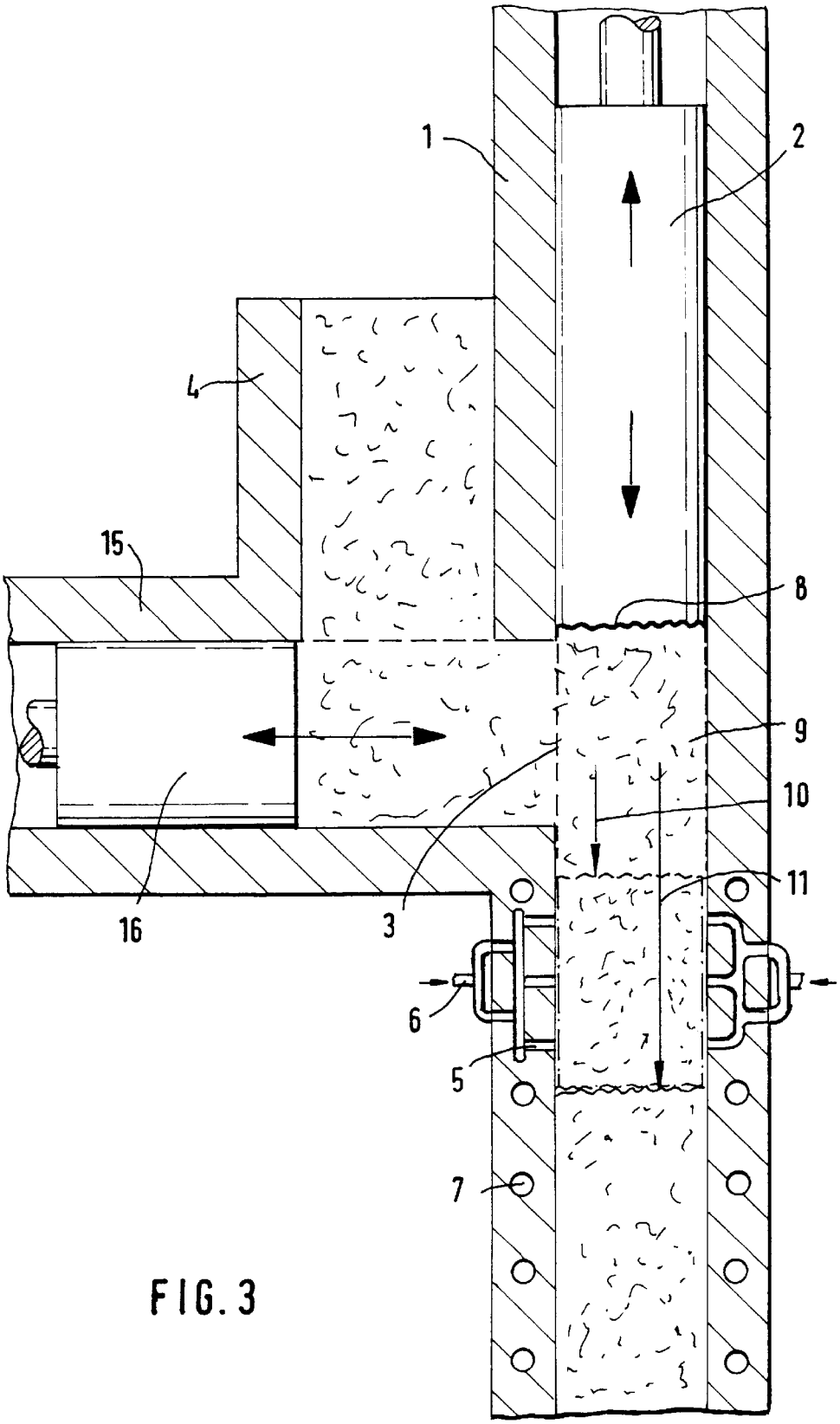
FIG. 3 is a view showing the device in accordance with the present invention in which the pressing mold is arranged vertically.

In the embodiment shown in FIG. 3, the pressing device is arranged vertically. The filling shaft 4 extends parallel to the tube 1. For introducing the mixture into the pressing mold 9, a filling slider 16 is provided. It is guided in a guide 15 which is arranged at the right angle to the filling shaft 4.

It will be understood that each of the elements described above, or two or more together, may also find a useful application in other types of methods and constructions differing from the types described above.

While the invention has been illustrated and described as embodied in method of and device for producing shaped parts, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of producing shaped parts from a not flowable mixture of cutting and/or fiber materials and a heat-hardenable binder, comprising the steps of introducing a mixture into a press with a pressing mold which is closed from all sides; hardening the introduced mixture; using hot gas or vapor introduced into the mixture during pressing as a part of heat energy required for the hardening; and performing pressing of the mixture in the pressing mold in two pressing strokes formed so that during a first pressing stroke, the pressing mold is closed and the mixture is slightly compressed, and during a second pressing stroke the mixture is finally compressed.

2. A method as defined in claim 1, wherein said using the hot gas and vapor includes introducing the hot gas and vapor into the mixture accommodated in the pressing mold in a direction which is substantially perpendicular to a pressing direction.

3. A method as defined in claim 1, wherein said using the hot gas or vapor includes introducing the hot gas or vapor after the first pressing stroke into the mixture; and further comprising additionally heating the mixture after the second pressing stroke by a heating device.

4. A device for producing shaped parts from a not flowable mixture of cuttings and/or fiber materials, comprising a tube; a pressing piston which is longitudinally displaceable in said tube; a pressing mold provided in said tube and having a radially arranged filling opening for filling said pressing mold with a mixture of cuttings and/or fiber material with a heat hardenable binder; a plurality of supply passages provided in a wall of said tube in a stroke region of said pressing piston for supplying hot gas or vapor into the mixture; and means for controlling said pressing piston so that it performs a first smaller pressing stroke with said pressing mold closed so as to slightly compress the mixture, and thereafter performs a greater pressing stroke to finally compress the mixture.

5. A device as defined in claim 4; and further comprising a collecting conduit connected with said supply passages and adapted to communicate with a reservoir for the hot gas or vapor.

6. A method as defined in claim 4, wherein said tube is arranged substantially horizontally.

7. A method as defined in claim 4, wherein said tube is arranged inclinedly.

8. A method as defined in claim 4, wherein said tube is arranged substantially vertically.

9. A method as defined in claim 4, wherein said pressing piston is hollow and is provided with a tubular extension extending into said pressing chamber, said tubular extension having a rear end which is connectable with a supply element for the hot gas or vapor, said tubular extension in a front region being provided with outlet openings communicating with a compacting region of the mixture.

10. A method as defined in claim 4, wherein said pressing piston has an outer surface facing a compacting region of the mixture and provided with a structuring.

11. A method as defined in claim 4; and further comprising a filling device including a filling shaft which is arranged parallel to said pressing mold and has a lower end which is open toward a stroke region, said filling device further having a filling slider which is displaceable horizontally in said filling shaft toward the stroke region.

* * * * *